US005809725A

United States Patent [19]

Cretti

[11] Patent Number: 5,809,725

[45] Date of Patent: Sep. 22, 1998

[54] SECTIONAL NOG STRUCTURE FOR FASTENING A COVERING ELEMENT TO A FOAMED PLASTIC SLAB AND CONSTRUCTION ELEMENT INCORPORATING SAID STRUCTURE

[75] Inventor: Piero Cretti, Ticino, Switzerland

[73] Assignee: Plastedil S.A., Chiasso, Switzerland

[21] Appl. No.: 503,582

[22] Filed: Jul. 18, 1995

[51] Int. Cl.[6] ..... E04B 2/06; E04B 2/86

[52] U.S. Cl. ..... 52/426; 52/309.15; 52/309.17; 52/442; 52/454; 52/565

[58] Field of Search ..... 52/309.1, 309.11, 52/309.12, 410, 426, 562, 438, 442, 563, 564, 565, 568, 454, 309.15, 309.17

[56] References Cited

U.S. PATENT DOCUMENTS

| | | | |
|---|---|---|---|
| 2,029,082 | 1/1936 | Odam | 52/564 |
| 2,248,348 | 7/1941 | Hall . | |
| 3,426,494 | 2/1969 | Hala | 52/410 |
| 3,471,988 | 10/1969 | Allen | 52/562 X |
| 4,040,222 | 8/1977 | Cull . | |
| 4,393,635 | 7/1983 | Long | 52/309.12 X |
| 4,397,128 | 8/1983 | Wolde-Tinsae . | |
| 4,426,061 | 1/1984 | Taggart | 52/309.12 X |
| 4,432,289 | 2/1984 | Norman et al. | 52/410 X |
| 4,454,702 | 6/1984 | Bonilla-Lugo et al. | 52/309.12 X |
| 4,545,163 | 10/1985 | Asselin | 52/562 X |
| 4,698,948 | 10/1987 | Yamashita et al. | 52/410 |
| 4,730,422 | 3/1988 | Young | 52/426 X |
| 4,765,109 | 8/1988 | Boeshart | 52/562 X |
| 4,805,366 | 2/1989 | Long | 52/309.11 |
| 4,829,733 | 5/1989 | Long | 52/309.11 |
| 4,889,310 | 12/1989 | Boeshart | 52/309.12 X |
| 4,949,515 | 8/1990 | Krecke | 52/563 |
| 5,107,648 | 4/1992 | Roby | 52/309.12 |
| 5,119,606 | 6/1992 | Graham | 52/309.11 X |
| 5,146,721 | 9/1992 | Candiracci | 52/309.11 X |
| 5,497,592 | 3/1996 | Boeshart | 52/562 X |

FOREIGN PATENT DOCUMENTS

| | | |
|---|---|---|
| 0073553 A2 | 3/1983 | European Pat. Off. . |
| 1938065 | 1/1971 | Germany . |
| 2220429 | 1/1990 | United Kingdom . |

OTHER PUBLICATIONS

European Search Report.

*Primary Examiner*—Michael Safavi
*Attorney, Agent, or Firm*—Whitham, Curtis & Whitham

[57] ABSTRACT

A sectional nog structure for fastening a covering element to a foamed plastic slab (5, 6, 35, 39, 49, 54) comprises at least one insert (2, 3), flush-insertable in the slab (5, 6, 35, 39, 49, 54) and associated with a tierod (4), having a base (10) accessible from the outside of the slab and constituting respective means for fastening to the slab (5, 6, 35, 39, 49, 54) the chosen covering element. Advantageously, this sectional nog structure allows to manufacture composite and modular construction elements, such as for example lost formworks and panels incorporating at least one foamed plastic slab and being able to support any covering element.

8 Claims, 6 Drawing Sheets

SECTIONAL NOG STRUCTURE FOR FASTENING A COVERING ELEMENT TO A FOAMED PLASTIC SLAB AND CONSTRUCTION ELEMENT INCORPORATING SAID STRUCTURE

BACKGROUND OF THE INVENTION

1. Field of the Invention

In its more general aspect, the present invention relates to accessories and construction elements incorporating one or more foamed plastic slabs which find a preferred use in building construction.

The present invention relates, more specifically, to a sectional nog structure for fastening a covering element to a foamed plastic slab, preferably but not exclusively of foamed polystyrene.

The present invention also relates to construction elements including at least one foamed plastic slab, such as, for example, lost formworks or panels employed in the construction of dividing walls, ceilings or flooring and incorporating said sectional nog structure.

In the following description and in the appended claims, by the term: covering element, is indicated either one or more layers incorporating any material having appropriate mechanical characteristics, such as for example plaster, plastic plaster, gypsum, concrete and the like or fire resistant characteristics such as for example combinations of non-woven fabric and bitumen, or panels or slabs of an appropriate material having decorative or structural functions, such as for example panels of plaster board, wood, marble slabs, corrugated sheet metal and the like.

As is known, in the building construction field in general and in the manufacture of so-called prefabricated products in particular, the use has steadily increased of so-called composite construction elements, i.e. including at least one foamed plastic slab, preferably foamed polystyrene, having the function of thermoacoustic insulation, and one or more covering elements in layers or panels of appropriate construction material, e.g. concrete, plaster, gypsum, wood and the like, imparting adequate mechanical and, optionally, decorative characteristics to the construction element, manufactured element or building.

If on the one hand the construction elements of the type mentioned exhibit characteristics of lightness, relative ease of installation and low cost, their acceptance in the field and their flexibility of use have until now been limited by the difficulty of associating in a sufficiently stable and durable manner the covering elements to the foamed plastic slab.

The foamed plastic employed has in itself a quite negligible ability of retaining the covering layers of plaster or concrete applied thereon, an ability totally lacking when the covering element is a wood panel or other rigid materials.

2. Known Art

In order to associate an appropriate covering layer to the foamed plastic slab, the constant teaching of the known art has been and is basically that of fastening the selected covering layer to the foamed plastic slab by means of a metal or plastic supporting net fixed to or supported at a short distance from the slab.

If a metal net is adopted, as for example in the case of lost formworks comprising a pair of foamed plastic slabs mutually spaced and stiffened by appropriate spacing means, both the slabs are surrounded by an actual cage of electrically welded metal wires, extending parallel and transversely thereto and which fulfill the dual function of conferring to the formwork the necessary mechanical resistance to the casting and sufficient supporting capacity of the covering layer.

The results are a considerable complexity of installation, the formation of "thermal bridges" between one side and the other of the foamed plastic slab due to the presence of the wires which pass through the slab and which compromise the insulating characteristics and involve formation of condensates and rust.

In order to prevent the formation of thermal bridges and at the same time provide an adequate support to the covering element, it has been proposed, for example as disclosed in Italian patent application No. 46869-A/78, to fasten on the opposite sides of the slab a metal net equipped with parallel ribbing in relief, partially covered with a thin layer of plastic cement and then plaster.

In both cases, however, the need of incorporating the metal supporting net in the covering layer involves inevitably the use of a considerable quantity of concrete or plaster, with a corresponding increase in production and/or installation time and cost on site.

When the net is plastic, on the other hand, the ability to retain the covering layer is so limited that the latter consists essentially of a few millimetres of a plastic plaster layer.

Lastly, if the covering element is a rigid panel, e.g. wood, the technology of the industry resorts constantly either to so-called sandwich structures in which the slab is enclosed between two rigid self-bearing panels, e.g. as described in U.S. Pat. No. 4,443,988, or to actual beams inserted in longitudinal grooves extending for the entire height of the slab, as illustrated for example in patent application WO 93/01371.

In both cases, the assembly operations of the foamed plastic slab with the covering element are laborious from the practical viewpoint, difficult to perform on site and in any case limited to a few very specific applications.

SUMMARY OF THE INVENTION

The technical problem underlying the present invention is therefore that of conceiving and making available a sectional nog structure which may embedded into one or more foamed plastic slabs, that would allow to fasten to the slab any covering element, whether formed by a layer of construction material or by a rigid panel, overcoming at the same time all the shortcomings afflicting the above mentioned known art.

The solution idea for such a problem is to support the covering element of the foamed plastic slab by means of a sectional nog structure comprising at least one insert flush-insertable in the slab and equipped with means accessible from outside the slab to fasten thereto the covering element, and a tierod constrained to a supporting element of the foamed plastic slab.

Working within the framework of the above idea and in conformity with a first embodiment of the present invention, the technical problem set forth above is solved by a sectional nog structure comprising at least a pair of opposite inserts, mutually connected at a predetermined distance by at least one tierod and flush-insertable in said slab, at least one of said inserts being equipped with respective means accessible from the outside of the slab for fastening said covering element to the slab.

In accordance with a first advantageous aspect of the present invention, the nog structure is sectional, i.e. it includes elements (insert, tierod) mutually associated in a removable manner and variably combinable depending on the specifications and contingent application requirements as explained in greater detail below.

The sectional nog structure of the present invention can be installed, preferably screwed, in the foamed plastic slab either immediately downstream of the slab forming operations or during on-site installation.

In accordance with the present invention, the foamed plastic of preferred use is foamed polystyrene.

Preferably, the foamed plastic slabs have an apparent density between 20 and 25 kg/m$^3$ and are produced by a continuous method in a known manner.

Depending on the specific use, the continuous slabs have a predetermined height varying between 60 and 330 cm and are cut in pieces of appropriate length, so as to facilitate the subsequent operations of processing and transport.

The foamed plastic slabs have a thickness of from 3 to 15 cm, chosen on a case-by-case basis, so as to ensure appropriate mechanical strength, e.g. to the cast in the case of lost formworks, as well as the desired thermoacoustic insulation characteristics.

For the purposes of the present invention, furthermore, it is preferable to use foamed plastic slabs appropriately treated with suitable flame-retardant additives designed to increase the flame-resistant characteristics and fire resistance thereof.

In accordance with the present invention and in order to avoid the formation of thermal bridges or condensates, the inserts of the sectional nog structure are made of an appropriate material which does not conduct heat and is preferably fire resistant.

Advantageously, the inserts are of plastic processable by moulding and preferably thermoplastic such as for example polyethylene or polypropylene or, optionally, phenol-formaldehyde resins.

For the purposes of the present invention, each of the inserts is preferably equipped with a substantially cylindrical body, externally provided with means which ameliorate securing to the foamed plastic slab in which they are flush-insertable.

Preferably, said means comprise a thread integral with the body of the insert, which at the same time facilitates insertion of the insert by screwing the same into the foamed plastic slab.

In order to facilitate the insertion of the insert in the slab, the latter can be equipped with lead-in holes, formed in a known manner, e.g. by milling, in accordance with a predetermined arrangement depending on the final use of the slab.

In accordance with a preferred embodiment, the means for fastening one or more covering elements to the slab protrude from a base formed in each insert at an end portion opposite the tierod and accessible from outside the slab.

Advantageously, said base also exerts the important function of retaining in position the foamed plastic slab in which the insert is embedded, facilitating the operations of manufacture, transportation and installation thereof.

In a first embodiment this base, preferably flattened and integral with the body of the insert, can itself constitute a support means for the covering element.

In this case, the base of the insert has an adequate thickness, preferably between 1.5 mm and 5 mm, such as to allow anchoring of the covering element, e.g. a plaster board panel, by means of screws or other similar fastening elements.

As an alternative, the means designed to allow or facilitate anchoring of the covering element to the slab may have a different structure and form, depending on the particular covering element which it is desired to employ, and can be either integral with the base of the insert or defined with the base itself by one or more metal elements associated with the insert and, optionally, with the supporting element of the foamed plastic slab as well.

These means can comprise, as better explained below, stakes, blocks, eyes extending from said base and preferably integrally formed therein.

In this first embodiment of the present invention, the sectional nog structure comprises a pair of plastic inserts engaged by screwing on opposite threaded ends of a metal tierod.

Depending upon the length of the tierod, the inserts mounted on opposite sides thereof can be inserted in parallel slabs mutually spaced and stiffened by a plurality of tierods or in the same slab in which they substantially mate.

In the second case, the bases of mating inserts extend along opposite sides of the slab to allow support of a covering element on both sides thereof.

Thus, for example, the sectional nog structure of the present invention allows construction of composite panels, having a modular structure, of the type comprising a single foamed plastic slab sandwiched between covering elements supported on the opposite sides thereof.

Advantageously, furthermore, the sectional nog structure with mating inserts constitutes at the same time a structural stiffening element increasing the mechanical characteristics and strength of the foamed plastic slab.

In accordance with another embodiment and working within the framework of the above mentioned technical solution idea, the sectional nog structure of the present invention comprises:

at least one insert, flush-insertable in a foamed plastic slab, provided with respective means accessible from the outside of the slab for fastening a covering element to the slab, a tierod, having a first end associated with the insert and a second opposite end associated with a bearing element for supporting said foamed plastic slab.

Even in this further embodiment, the nog structure of the present invention is sectional, i.e. it comprises elements (insert, tierod) mutually associated in a removable manner.

In this case, the tierod is however associated at the end opposite the one engaged in the insert, with an appropriate bearing element designed to support both the foamed plastic slab and the covering elements fastened thereon.

The tierod is therefor equipped with appropriate fastening or engagement means with the bearing element which can be a supporting wall of wood or other material, a beam or any supporting element constrained rigidly to a structure having adequate mechanical strength characteristics.

As to the characteristics and structure of the insert flush-insertable in the foamed plastic slab, this embodiment of the nog structure does not differ from that described above with reference to the preceding embodiment.

Even this embodiment of the sectional nog structure, therefore, allows to manufacture construction elements of the composite and modular type, incorporating at least one foamed plastic slab of predetermined size and weight, variously combinable to form more complex composite structures.

In accordance with another aspect of the present invention, the sectional nog structure described above allows to provide construction elements of the so-called modular type, in which one or more foamed plastic slabs of predetermined size and weight, equal to or different from one another, are assembled to form more complex composite structures.

Thus, for example, the sectional nog structure described above allows to provide modular lost formworks, of the type comprising a pair of foamed plastic slabs mutually associated at a predetermined distance by respective spacer means.

In this case, one or more metal reinforcing wires or bars can be fastened, e.g. by welding, to the metal tierods connecting the inserts, so as to reinforce adequately a layer of concrete poured between the foamed plastic slabs.

In a preferred embodiment, the nog structure comprises means for facilitating installation and positioning of the metal reinforcing rods before pouring the concrete. Preferably, said means comprise one or more eyes, integral with the tierod, in which the metal rods designed for reinforcing the concrete are inserted and subsequently fastened, e.g. by welding.

The formwork thus provided is not only capable of receiving in an adequate manner a casting of concrete or other suitable construction material, but is also capable of supporting at the same time any external covering element after having completed the cast.

Thanks to its own modular characteristics and as better explained below, furthermore, the sectional nog structure of the present invention allows to associate to the tierod inserts—even of different types—having the support means better suited to support the desired covering element.

In this manner, the nog structure of the present invention allows to advantageously associate on both sides of the formwork or double-slab wall, those covering elements, even of different types, which best meet the construction and/or decorative requirements of the product it is intended to manufacture.

Since the inserts are associated in a removable manner with the respective tierods, furthermore, the further advantages are achieved of a possible access to the concrete casting space, so as to arrange more easily the reinforcing rods, and a possible removal of one of the foamed plastic slabs after hardening of the casting, so as to be able to work directly on the concrete wall and apply thereto the desired covering and finishing layers.

In accordance with another advantageous feature of the present invention, particularly appreciable in the case of lost formworks, it is possible to use in the same formwork both nog structures with double insert and tierod and nog structures with a single insert to the greater benefit of flexibility of use of the formwork.

In both cases, the presence of plastic inserts, notoriously a good thermal insulating material, allows to eliminate in a substantially complete manner the development of thermal bridges between the inside and the outside of each slab, contributing to impart optimal characteristics of thermoacoustic insulation to the construction element as a whole.

In the lost formworks of the present invention, the spacer means advantageously comprise the tierods of the nog structure with double insert, used and arranged in appropriate number and positions calculated by an expert in the art depending upon the characteristics of the casting and wall it is intended to build.

In said formwork construction elements, furthermore, the nog structure ensures correct positioning of the foamed plastic slab either in the presence of tensile stress (e.g. during concrete pouring), or in the presence of compressive stress (e.g. during operations of manufacture, transport, cutting and installation) of the formwork.

The nog structure of the present invention, therefore, fulfills the dual advantageous function of tierod or strut depending upon the type of stress, tractive or compressive, the foamed plastic slabs are subjected to.

As mentioned above, furthermore, the sectional nog structure of the present invention allows to manufacture composite panels having modular structure of the type comprising a single foamed plastic slab sandwiched between covering elements supported on the opposite sides thereof.

In additional embodiments of the nog structure, it is also possible to provide so-called "floating" floors and false ceilings.

The latter comprise a foamed plastic slab and a plaster board panel, both supported through the above tierod by a supporting element extending from the true ceiling.

In any case, in all the construction elements of the present invention the covering element can comprise both a layer of appropriate construction material such as for example plaster or cement, or of a material having fire-retarding or fire-resistant properties, such as for example combinations of non-woven fabric and bitumen, and another panel of wood, plaster board, rigid plastic, etc. having a decorative and/or a structural function.

Depending upon the covering element selected, whether having structural characteristics or not, the construction elements may advantageous have bearing characteristics, i.e. be able to support independently possible static loads applied thereon.

BRIEF DESCRIPTION OF THE DRAWINGS

The characteristics and advantages of the invention will be more readily apparent from the description of some embodiments thereof, given below by way of non-limiting example with reference to the annexed drawings, wherein.

DETAILED DESCRIPTION OF THE PREFERRED EMBODIMENTS

With reference to the figures, reference number 1 indicates as a whole a sectional nog structure in accordance with the present invention.

Figure 1:
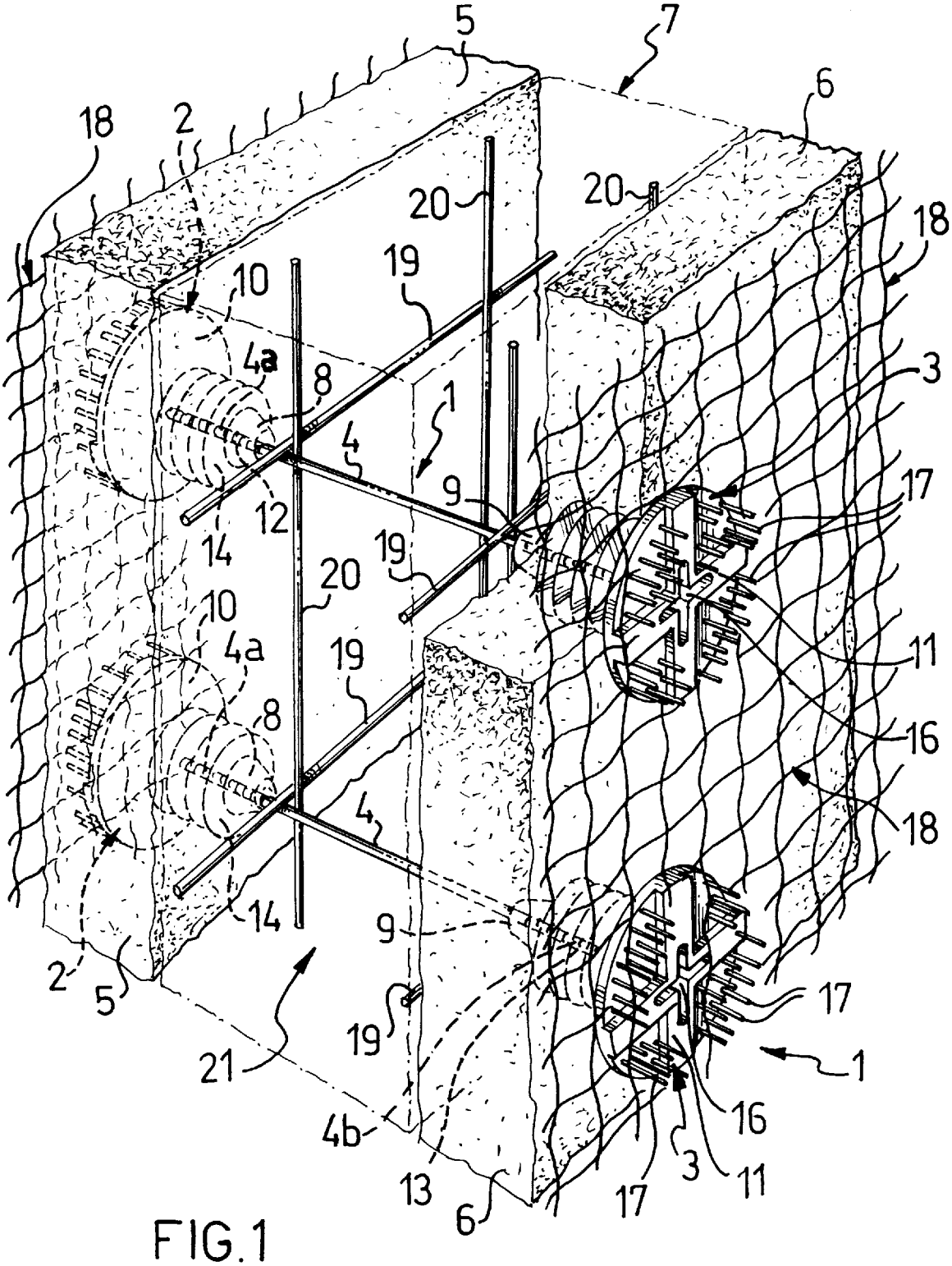
FIG. 1 shows a perspective and partially cross sectioned view of a construction element, in particular a lost formwork, incorporating a sectional nog structure in accordance with the present invention.

According to a first embodiment thereof, illustrated in FIG. 1, the sectional nog structure 1 is inserted in a lost formwork indicated as a whole by 7 and comprises a pair of opposed inserts 2, 3 mutually connected at a predetermined distance by a metal tierod 4.

The metal tierod 4 has in turn a predetermined length, determinable in advance during design depending upon the wall thickness it is desired to manufacture by means of the formwork 7.

The inserts 2 and 3 are obtained in a known manner by moulding and are of thermoplastic material, e.g. and preferably polyethylene.

Said inserts comprise respective bodies 8, 9, substantially cylindrical, having at one end flattened bases 10, 11 an at the opposite free end a truncated cone tapering, designed to aid their insertion in the foamed plastic slabs 5 and 6.

Blind holes 12, 13 are also axially formed in said bodies 8, 9 in which opposite threaded ends 4*a*, 4*b* of the metal tierod 4 are engaged by screwing.

In order to fasten stably the inserts 2, 3 to the slabs 5, 6 of foamed plastic in which they are flush-insertable, the inserts are advantageously provided with threads 14, 15 integral with their bodies 8, 9 and which aid at the same time their insertion by screwing into the foamed plastic slab.

Preferably, a substantially cross-shaped recess 16 is formed in the bases 10, 11 to receive a tool, not shown, for screwing the inserts 2, 3 into the respective slabs 5, 6 of foamed plastic and on the respective opposed ends 4*a*, 4*b* of the metal tierod 4.

Figure 3:
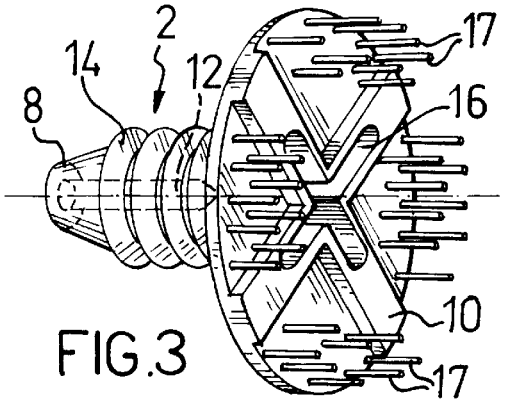

The bases 10, 11 are also equipped—as better illustrated in FIG. 3—with a plurality of stakes, all indicated by 17, integral with the inserts 2, 3 and extending perpendicularly therefrom.

The stakes 17 constitute respective means designed to allow anchoring of a covering layer to the slabs 5 and 6 of foamed plastic.

In the lost formwork 7 of FIG. 1, the stakes 17 support a plastic net 18, e.g. of polyethylene or fiber glass, fixed thereto in a known manner e.g. by heat welding.

In accordance with the present invention, the lost formwork 7 also comprises a plurality of horizontal and vertical metal reinforcing rods 19, 20, fixed in a known manner to the metal tierod 4 of the nog structure 1 and designed to reinforce a concrete casting poured in a hollow space 21 defined between the two foamed plastic slabs 5, 6.

Figure 14:
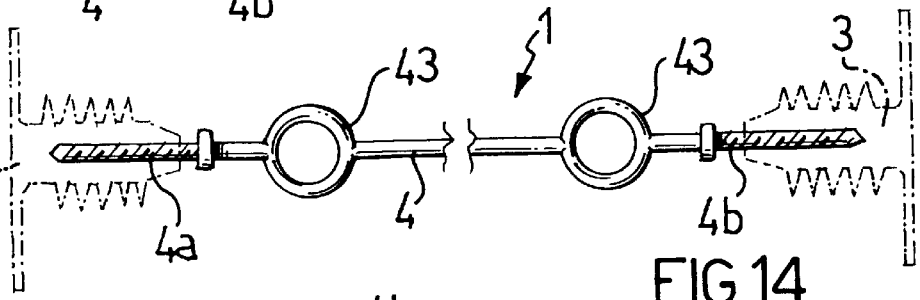

In an alternative embodiment illustrated in FIG. 14, the nog structure 1 is equipped with means which facilitate installation and positioning of the horizontal metal rods 19 before the concrete cast.

Preferably, the above means comprise one or more eyes 43, integral with and spaced apart along the metal tierod 4, in which the horizontal metal rods 19 are inserted and subsequently fixed, e.g. welded.

Advantageously, the lost formwork 7 allows to provide bearing walls of the so-called "continuous" type, quake-proof, having a thickness determined during design and provided on-site by prearranging tierods 4 of appropriate length.

To this end, the width of the hollow space 21 of the lost formwork 7 may vary from 6 to 180 cm.

In the lost formwork 7, furthermore, the slabs 5, 6 fulfill the dual function of containing the concrete casting and, once the covering elements have been applied, acting as thermoacoustic insulation elements.

Additionally, in order to provide an adequate endurance to the casting, the nog structures 1 are arranged in checkerboard design at predetermined distances, variable between 15 cm and 60 cm for the entire length and width of the lost formwork 7.

Preferably, the so-called "external" slab of the formwork, i.e. that supporting a covering element which covers the external part of a building, has a thickness from 5 to 15 cm, while the "internal" slab has a thickness of from 3 to 5 cm.

In accordance with another advantageous feature of the present invention, the lost formwork 7 can be either assembled at the building site immediately before pouring the concrete, or preassembled at the works with or without the plastic net 18 before the installation operations.

In both cases, the lost formwork 7 can be assembled by forming in advance a cage comprising the rods 19, 20 and the metal tierods 4 mutually welded together and then associating to the cage the foamed plastic slabs 5, 6 by screwing the inserts 2 and 3 onto the threaded ends 4*a*, 4*b* of the tierods 4.

Advantageously, moreover, the modular characteristics of the nog structure 1 allow to disassemble and re-use, after hardening of the concrete casting, one of the foamed plastic slabs 5, 6 by merely unscrewing the inserts mounted in the slab which it is desired to recover.

Additional embodiments of inserts particularly suited for use in a double-wall construction element such as e.g. the lost formwork 7 illustrated above, are shown in FIGS. 2, 6, 7 and 8 in which reference is made for convenience of discussion only to the nog 2.

Figure 2:
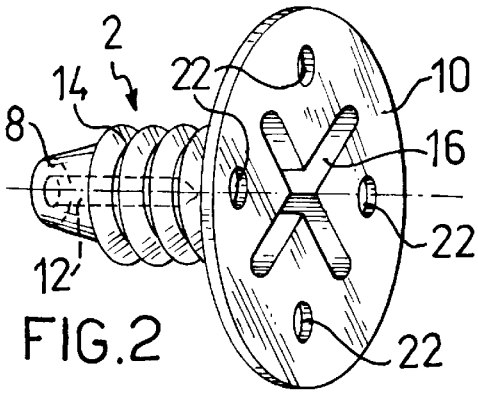
FIGS. 2 to 8 show perspective views in enlarged scale of alternative embodiments of some details of the sectional nog structure of FIG. 1.

FIG. 2 shows in particular an insert having a flattened base 10 equipped with lightening holes 22 designed to aid penetration and fastening of a plaster covering layer.

In this embodiment, the thickness of the base 10 is chosen in such a way as to receive and adequately retain self-threading screws, not shown, for supporting a rigid covering element, e.g. a plaster board, also not shown.

Figure 6:
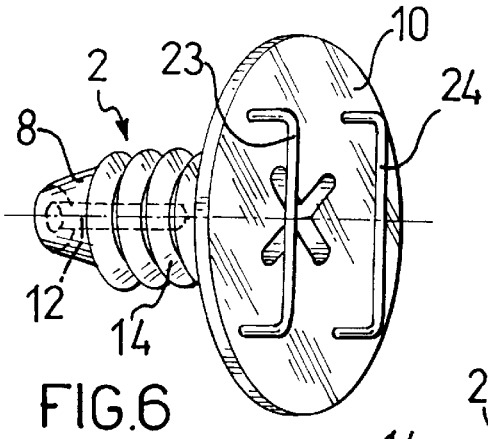

The insert 2 shown in FIG. 6 comprises a pair of parallel eyes 23, 24 forming respective bridge elements protruding from the base 10, which constitute respective fastening means for the net 18.

This embodiment of the insert is particularly useful in cases where the net 18 of the covering layers comprises stretched metal or electrically welded metal wires.

Figure 7:
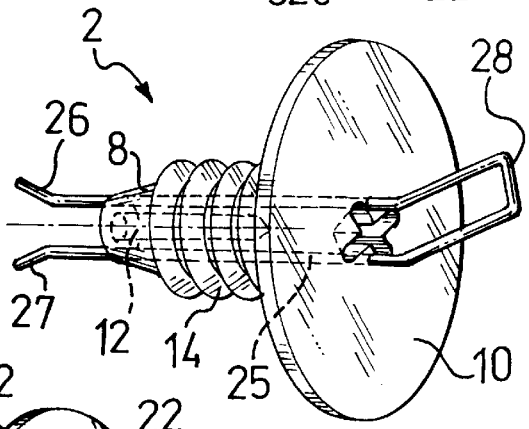

In the insert 2 shown in FIG. 7, a supporting element 25, substantially U-shaped, is provided, including opposed parallel arms 26, 27 extending longitudinally in the insert 2 and a base portion 28 defining an eye extending and projecting from the base 10.

Said arms 26, 27 are in turn equipped with respective ends projecting from the insert body 8 on the side opposite the base 10 and designed to be embedded in the concrete casting poured in the hollow space 21 of the lost formwork 7.

The nog structure 1 incorporating such an insert is advantageously capable of supporting a stony slab, such as marble or granite, or a slab of some other material of considerable weight.

Figure 8:
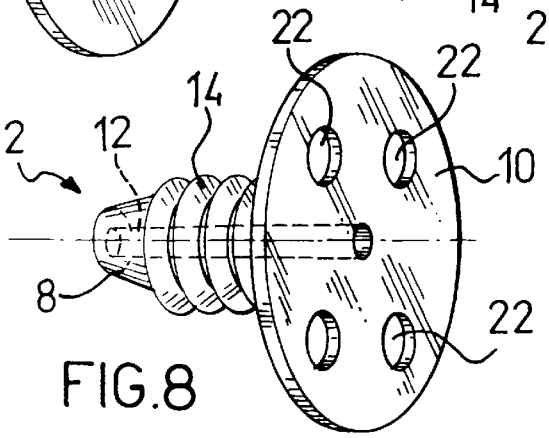
Figure 9:
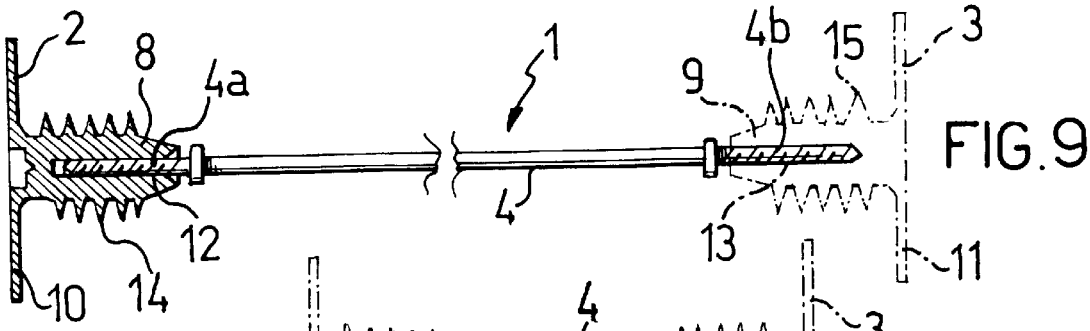
FIGS. 9 to 15 show side views in enlarged scale and partial cross section of alternative embodiments of the sectional nog structure of FIG. 1.

In the nog structure incorporating at least one insert 2 of the type shown in FIG. 8 in which the hole 12 is a passing hole, the metal tierod 4 may project from the base 10 for a predetermined portion of its own threaded end 4*a*.

In this case, the means for fixing an appropriate covering element to the foamed plastic slab advantageously consist of the projecting end of the metal tierod 4.

Thus, for example, it is possible to fix to said end a metal net which is subsequently embedded in a layer of plaster.

Figure 20:
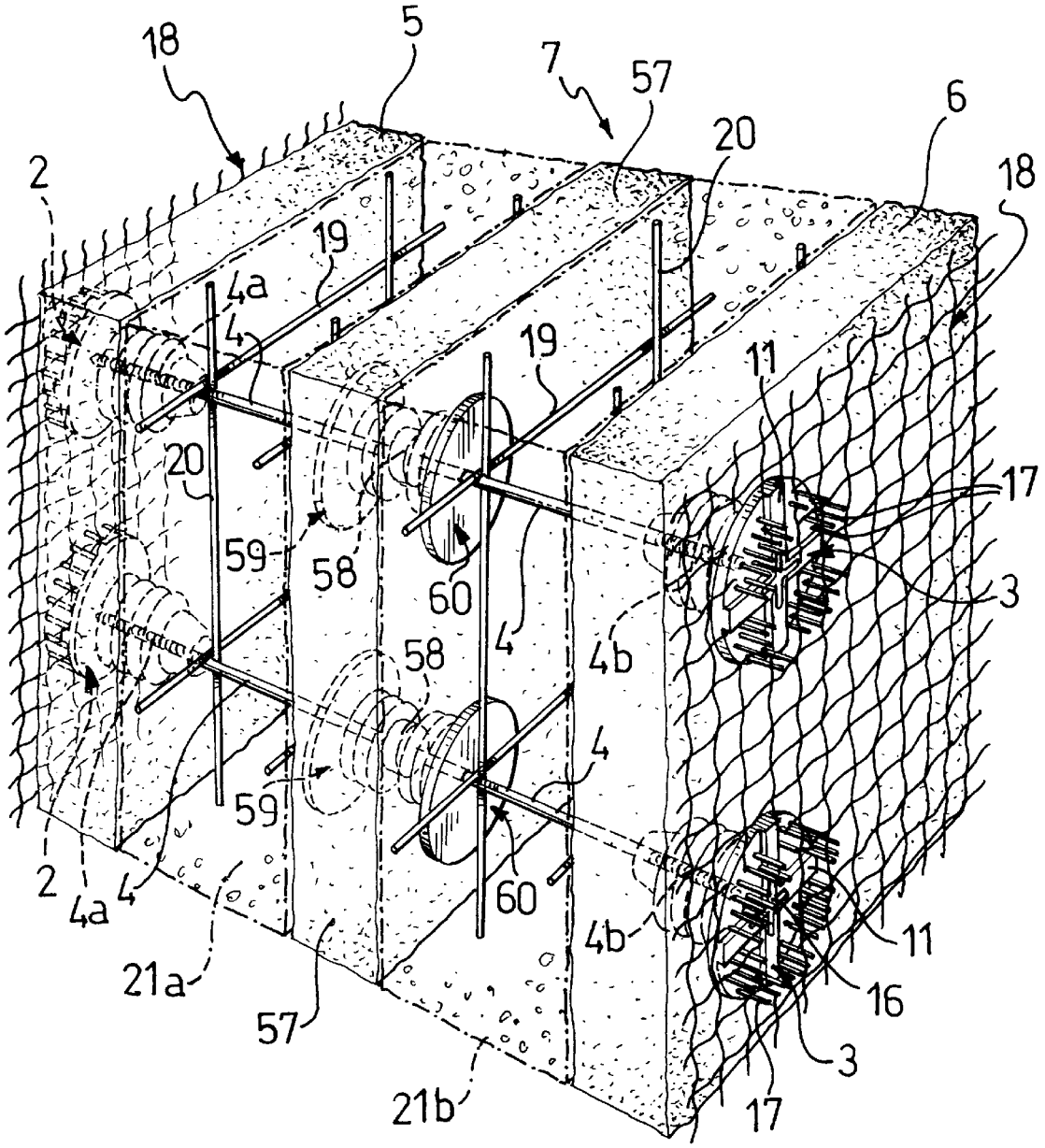
FIG. 20 shows a perspective and partially cross sectioned view of a lost formwork incorporating a further embodiment of the sectional nog structure in accordance with the present invention.

In another embodiment, shown in FIG. 20, a nog structure 1 incorporating inserts of the type shown in FIG. 8 allows to provide a lost formwork 7 in which another foamed plastic slab 57 is placed between the slabs 5 and 6.

In this embodiment, the intermediate slab 57 is supported in a plane of symmetry of the lost formwork 7, so as to divide the hollow space 21 in two adjacent equal and symmetrical portions 21*a*, 21*b*.

The lost formwork 7 thus structured finds a preferred use in the construction of peripheral walls for row houses, where it allows an exact apportionment of the dividing wall of adjacent houses.

In this embodiment of the nog structure, an annular shoulder 58 is preferably formed in a median position on the metal tierod 4, so as to form opposite stop means for a pair of inserts 59, 60 positioned on opposite sides of the intermediate slab 57.

Thanks to the presence of a passing hole, said inserts can be screwed into the intermediate slab 57 and at the same time run on the metal tierod 4 until abutting against the annular shoulder 58.

In the lost formwork described above, the sectional nog structure 1 also exerts the further advantageous function of holding in position the intermediate slab 57 both during transport and installation, as well as during the concrete casting into the adjacent hollow spaces 21*a*, 21*b*.

In another embodiment of the present invention, not shown, the sectional nog structure 1 described above may be advantageously used, thanks to its own modular characteristics, in the manufacture of double-wall construction elements in which the bearing structural element—placed between the foamed plastic slabs 5, 6—is not a concrete casting but a different supporting element such as e.g. one or more H-beams.

Construction elements of this type are represented e.g. by the composite walls for industrial sheds, comprising a pair of foamed plastic slabs mutually spaced and stiffened by a plurality of H-beams conferring to the walls the necessary mechanical strength.

The nog structure of the present invention provides in this case inserts equipped with means capable of supporting a covering layer or a panel (e.g. the inserts shown in FIGS. 2, 3 or 8) on the internal slab and inserts equipped with means capable of supporting a suitably shaped section or plate on the external slab.

Figure 4:
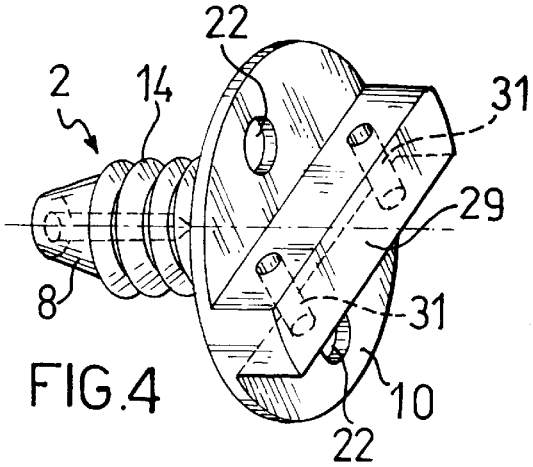

An insert 2 particularly suited to this end is shown in FIG. 4.

It comprises a block or riser 29, integral with the base 10 and having transversely passing holes 30, 31 for receiving self-threading screws, not shown, for fastening a shaped plate.

Advantageously, it is also possible to form—with an appropriate arrangement of said passing holes—an airspace between the plate and the external foamed plastic slab, with a further increase in the thermoacoustic insulation characteristics of the construction element ("self-ventilated" wall).

Figure 5:
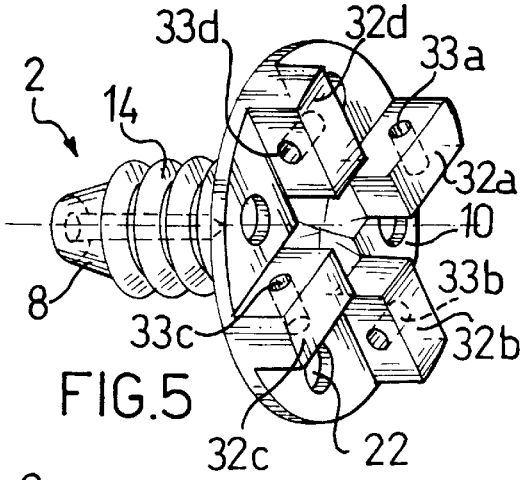

The insert 2 shown in FIG. 5, comprising a plurality of blocks or risers 32*a*–32*d* forming a cross and having respective transverse passing holes 33*a*–33*d*, allows to fasten appropriate covering panels and covering elements used for building the so-called "floating floors".

Figure 17:
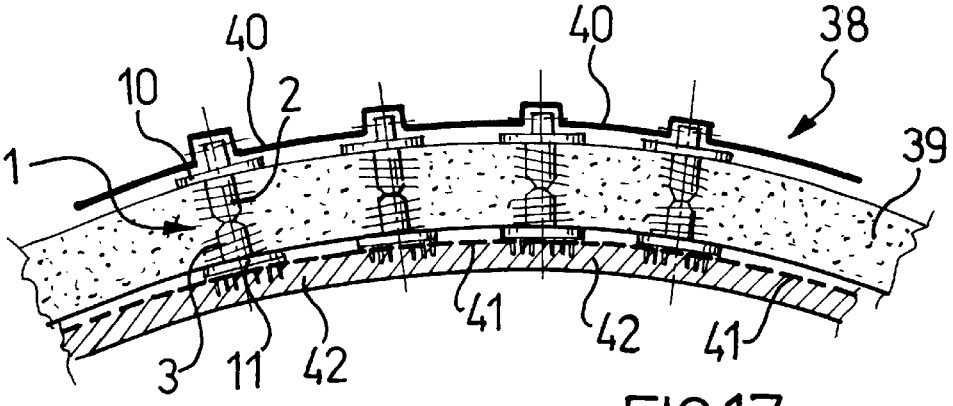
FIG. 17 shows a cross section of a roof element for industrial sheds incorporating a sectional nog structure in accordance with the present invention.
Figure 16:
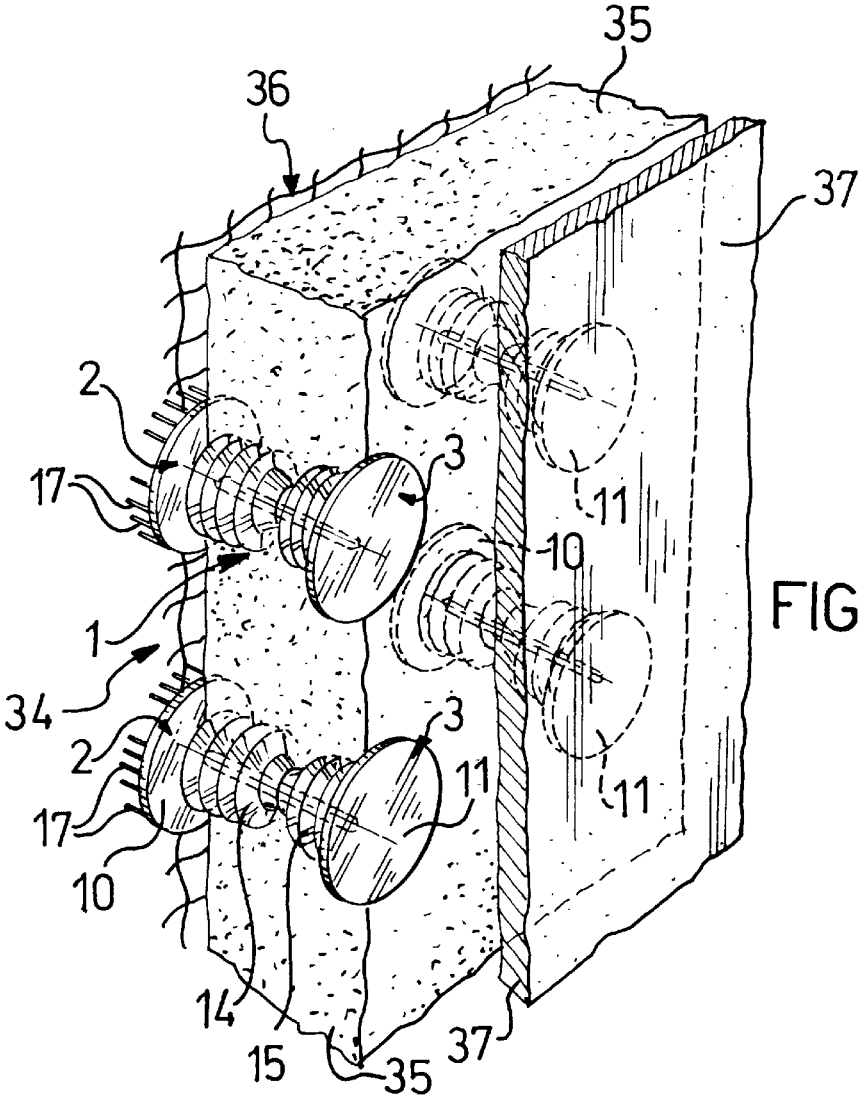
FIG. 16 shows a perspective and partially cross sectioned view of a construction element, in particular a composite panel, incorporating a sectional nog structure in accordance with the present invention.

FIGS. 16 and 17 show additional embodiments of a nog structure 1 and of construction elements including a single foamed plastic slab in accordance with the present invention.

FIG. 16 shows in particular a composite panel 34 forming e.g. a dividing wall for interiors and comprising a foamed plastic slab 35 in which a plurality of nog structures 1, equipped with inserts 2 and 3 substantially mating with each other, is inserted.

Figure 10:
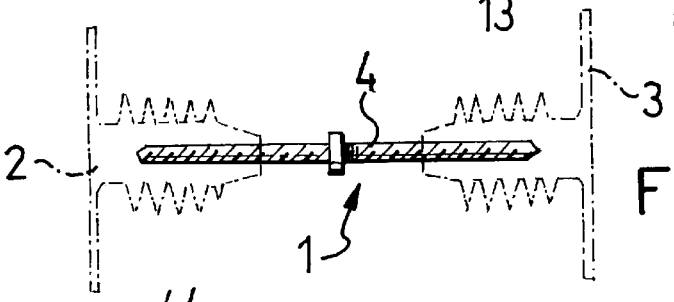

Preferably, a nog structure of this type, schematically shown in FIG. 10, comprises a tierod 4 of a length such that when the inserts 2 and 3 are completely screwed down, the respective bases 10, 11 thereof are substantially flush with the foamed plastic slab 35.

In the composite panel 34, furthermore, the inserts 2 and 3 are different from each other and are respectively equipped with stakes 17 for the support of a net 36 heat welded thereto and with a flattened base 11 of adequate thickness for supporting a plaster board panel 37.

In accordance with the present invention, a layer of appropriate covering, e.g. of plastic plaster, may be applied to the net 36 so as to impart to the panel adequate aesthetic characteristics.

FIG. 17 shows a roofing tile 38 particularly suited for the construction of vault arches for industrial building construction.

The roofing tile 38 comprises a foamed plastic slab 39, substantially arch-shaped, wherein a plurality of sectional nog structures 1 equipped with substantially mating inserts 2, 3 is inserted.

As described hereinabove with reference to the composite panel 34, the sectional nog structure 1 comprises a metal tierod 4 of a length such that once the inserts 2 and 3 are completely screwed thereon their respective bases 10, 11 are substantially flush with the foamed plastic slab 39.

In this case as well, the inserts 2 and 3 are different from each other and are equipped with blocks or risers 29 respectively for supporting an appropriately shaped plate 40 and with stakes 17 for supporting a net 41 heat welded thereto.

In accordance with the present invention, a mortar layer 42 is applied to the net 41 so as to impart to the roofing tile 38 adequate finishing characteristics.

Advantageously, the roofing tile 38 of the invention allows to provide vault arches having a breadth of approximately 3 m and possessing bearing characteristics (up to 100 $kg/m^2$) which make it particularly suited for industrial shed roofing.

In the FIGS. 11–13, 15, 18 and 19 are schematically shown additional embodiments of the nog structure and of construction elements in accordance with the present invention.

In the following description and in said figures the parts of the nog structure 1 structurally or functionally equivalent to those illustrated above with reference to the other figures, will be indicated by the same reference numbers and will not be further described.

In accordance with these additional embodiments, the nog structure 1 comprises a single insert 2 while the tierod 4 is associated at its first threaded end 4*a* with the insert 2 and, at the opposite end 4*b*, with a bearing element for supporting said foamed plastic slab.

As to the characteristics and structure of the insert 2 which may be flush-inserted in the foamed plastic slab, this embodiment of the nog structure 1 does not differ from the previous one described above.

For the sake of simplifying the present description, reference is made below to the insert shown in FIG. 2, it being understood that any one of the inserts shown in FIGS. 3 to 8 could be used in the same manner depending upon the characteristics of the covering element which it is desired to fasten to the foamed plastic slab.

These alternative embodiments of the nog structure 1 are particularly suited to provide construction elements incorporating a single foamed plastic slab.

Again, in this further embodiment, the nog structure 1 of the present invention is entirely modular, so that the tierod 4 is associated in a removable manner both with the insert 2 and with the bearing element of the foamed plastic slab.

Figure 11:
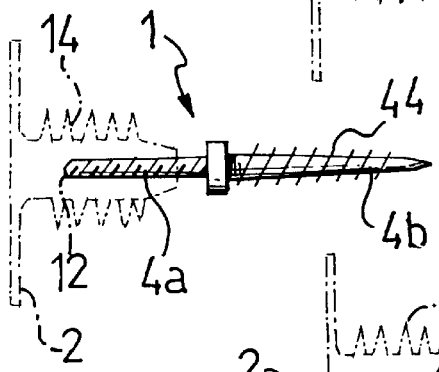

FIG. 11 shows in particular a nog structure in which the end 4*b* of the tierod 4 is equipped with a threading 44 for engaging with a wooden bearing element, e.g. a wall or beam, not shown.

Figure 12:
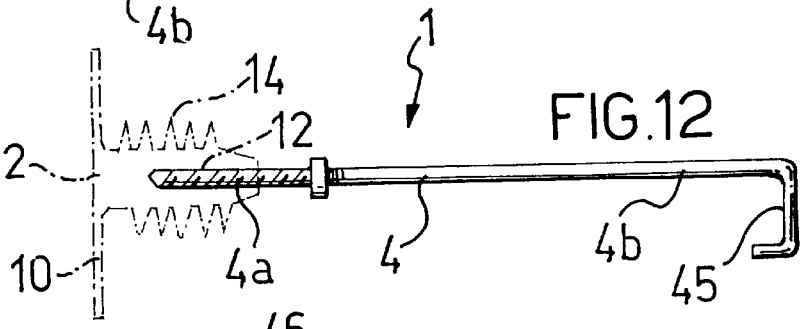

In the nog structure 1 shown in FIG. 12, the end 4*b* of the tierod 4 is formed substantially in hook form and ends with a U-shaped portion 45 apt to engage a beam not shown.

In the nog structure 1 shown in FIG. 13 the end 4*b* of the tierod 4 is equipped with a threading 46 in which is engaged a nut 47 for fastening, as explained more fully below, to a supporting bracket not shown here.

Figure 15:
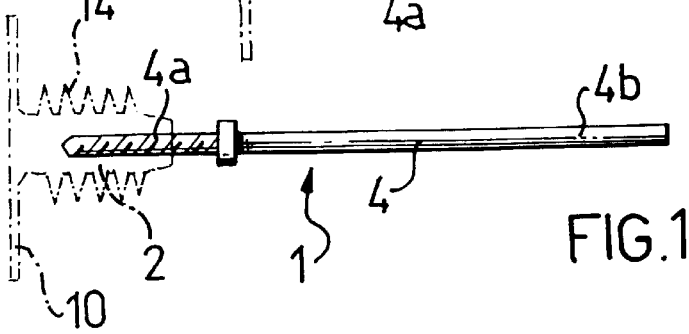

In the nog structure 1 shown in FIG. 15, the end 4*b* of the tierod 4 is smooth and can be engaged in an adjustable manner by clamp means not shown and fixed in a known manner to a bearing wall.

This embodiment of the nog structure 1 allows advantageously to provide so-called "self-ventilated" vertical walls, i.e. having an airspace between the bearing wall and the composite panel incorporating the foamed plastic slab.

Even this embodiment of the nog structure 1 in accordance with the present invention, in all its modifications explained above, allows to manufacture construction elements of the composite and modular type incorporating at least one foamed plastic slab of predetermined dimensions and weight, elements variously combinable to form more complex composite structures.

Figure 18:
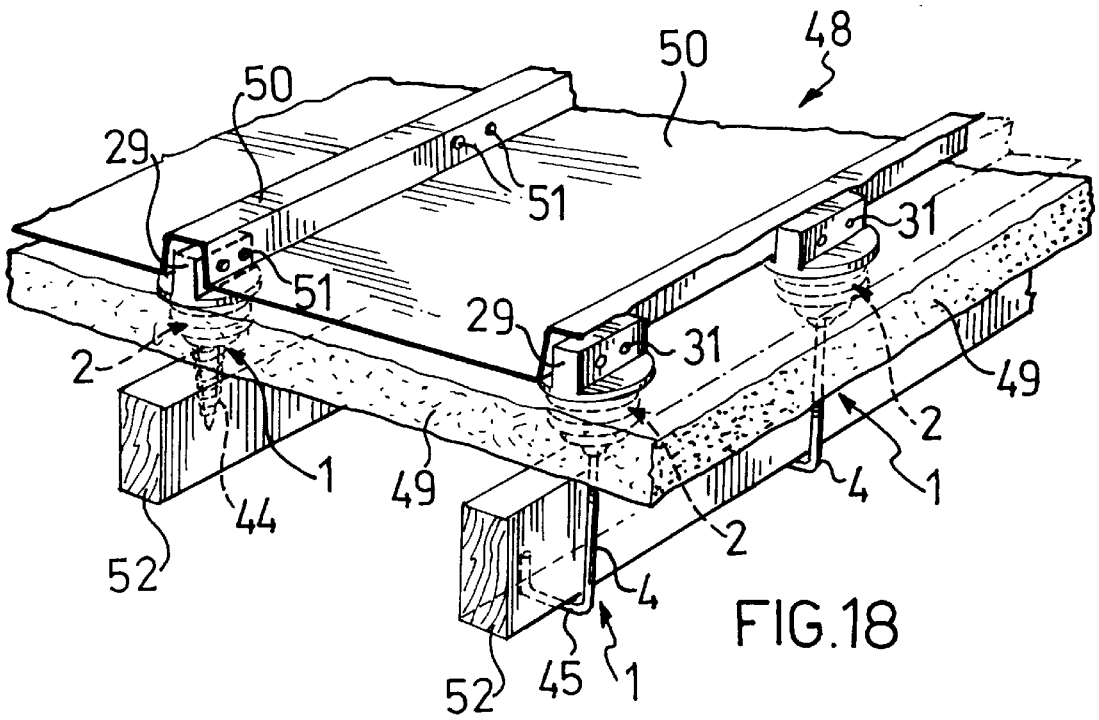
FIG. 18 shows a perspective and partially cross sectioned view of a further embodiment of a roof element for industrial sheds, incorporating a sectional nog structure in accordance with the present invention.
Figure 19:
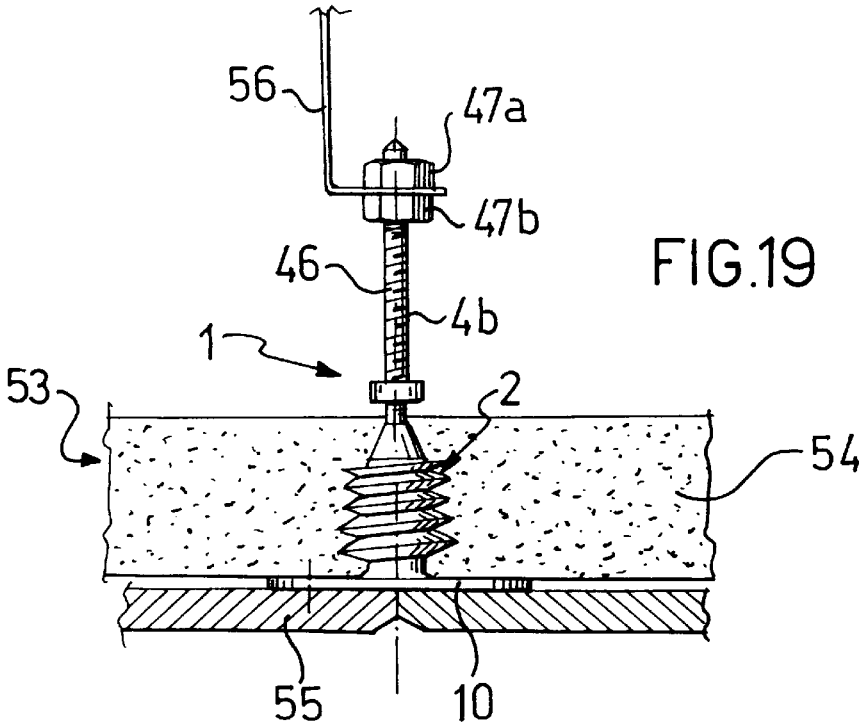
FIG. 19 shows a perspective and partially cross sectioned view of a construction element, in particular a composite panel for false ceilings, incorporating a sectional nog structure in accordance with the present invention.

Two construction elements in accordance with the present invention are illustrated e.g. in FIGS. 18 and 19.

FIG. 18 shows in particular a roofing element 48 for industrial sheds, comprising a foamed plastic slab 49 in which a plurality of nog structures 1 equipped with a single insert 2 is inserted.

In this case, the insert is the type shown in FIG. 4, i.e. comprises a block or riser 29 designed to support a shaped metal sheet 50 by means of screws 51 conventional per se.

Merely by way of example, the foamed plastic slab 49 is in turn associated with a plurality of wooden beams 52 by means of two different embodiments of the nog structure 1 in accordance with the present invention.

According to a first variant of the nog structure, shown schematically in FIG. 11, the tierod 4 is screwed on one side to the insert 2 and on the other side to one of the beams 52.

In accordance with a second variant of the nog structure, shown schematically in FIG. 12, the metal tierod 4 is screwed on one side to the insert 2 and on the other side is hooked to one of the beams 52 by means of its own U-shaped end portion 45.

FIG. 19 shows schematically a false ceiling 53 comprising a foamed plastic slab 54 and a plaster board panel 55 supported through the nog structure 1 by a bracket 56 fixed to the true ceiling.

Figure 13:
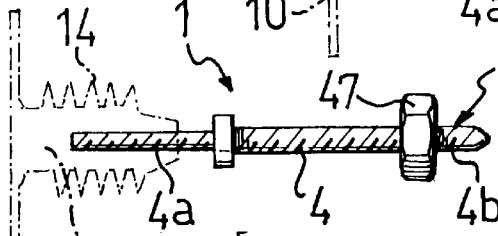

In this case, the nog structure 1 of preferred use is that schematically represented in FIG. 13, i.e. it comprises a tierod 4 having a threaded end 4*b* engaged by a pair of nuts 47*a*, 47*b* for fastening to the bracket 56.

The plaster board panel 55 is fastened to the base 10 of the insert 2 by means of conventional screws not shown.

From the foregoing description and discussion the advantages of the present invention are evident.

In accordance with a first advantageous feature, the nog structure according to the present invention allows to combine the inserts and tierod versions best suited to manufacture the desired construction element.

The combinableness of the nog structure also allows to associate a number of foamed plastic slabs, equal to or different from one another, so as to form construction elements having the desired characteristics.

In all its embodiments, moreover, the construction elements of the present invention are of the modular type and can be dimensioned so as to facilitate as much as possible the operations of assembly, transportation and final installation on site.

Thanks to the presence of the bases accessible from the outside of the slabs and, optionally, of appropriate fastening means, the nog structure of the present invention advantageously allows to support any covering element for the foamed plastic slab or slabs, whether in the form of a panel or of a layer of appropriate material.

In all its embodiments, moreover, the nog structure of the present invention exhibits optimal characteristics of tensile and compressive strength, as well as high thermoacoustic insulation characteristics.

Thanks to its extreme structural simplicity and large use of plastic, the sectional nog structure and the construction elements of the present invention can be mass produced and assembled at low cost with techniques widely known and used in the art.

I claim:

1. A construction assembly for manufacturing walls for buildings, comprising:

a pair of plastic slabs spaced by at least one sectional nog for fastening a covering element to at least one of said plastic slabs, said nog comprising:

at least a pair of opposite inserts, made of a heat-insulating material, mutually connected at a predetermined distance by at least one tierod having a substantially smooth outer surface and flush-insertable in said pair of plastic slabs;

adjusting means for adjustably engaging at least one of said inserts on one end of said tierod, so as to axially regulate the position of said at least one insert within said at least one plastic slab; and cover fastening means for fastening a cover projecting from said at least one of said inserts, said cover fastening means being accessible from an outside surface of said at least one plastic slab for fastening said covering element.

2. A construction assembly according to claim 1, further comprising a plastic net for supporting the cover.

3. A construction assembly according to claim 1, wherein said covering element comprises one of said layer of plaster, cement, non-woven fabric and bitumen.

4. A construction assembly according to claim 1, further comprising a plurality of metal reinforcing wires supported by said sectional nog structure between said pair of plastic slabs.

5. A construction assembly according to claim 1, further comprising one of a plaster board, wood and marble covering panel on at least one of said pair of plastic slabs.

6. A construction assembly according to claim 1, further comprising a third plastic slab supported between said pair of plastic slabs.

7. A sectional nog structure for fastening a covering element to a foamed plastic slab, comprising;

at least a pair of opposite inserts, made of a heat-insulating material, mutually connected at a predetermined distance by at least one tierod having a substantially smooth outer surface and flush-insertable in said slab;

adjusting means for adjustably engaging at least one of said inserts on one end of said tierod, so as to axially regulate the position of said at least one insert within said slab; and cover fastening means for fastening a cover projecting from at least one of said inserts, said cover fastening means being accessible from an outside surface of the slab, wherein at least one of said inserts comprises a substantially cylindrical portion having a slab fastening means for fastening said insert to said foamed plastic slab, and wherein said slab fastening means comprises a threaded portion integral with said substantially cylindrical portion.

8. A sectional nog structure for fastening a covering element to a foamed plastic slab, comprising;

at least one insert flush-insertable in said slab;

cover fastening means connected to said at least one insert accessible from an outside surface of the slab, for fastening the covering element to the slab;

a tierod having a first end connectable to said at least one insert and a second end connectable to a bearing element for supporting said slab; and a slab fastening means for fastening said at least one insert to said slab, wherein said at least one insert comprises a substantially cylindrical portion externally provided with said slab fastening means, and wherein said slab fastening means comprises a threaded portion integral with said substantially cylindrical portion.

* * * * *